United States Patent [19]

Eberlein

[11] Patent Number: 4,475,841

[45] Date of Patent: Oct. 9, 1984

[54] INTERSECTION JOINT FOR WOODEN MEMBERS OF TRUSSES PARTICULARLY FOR SPACEFRAMES

[75] Inventor: Helmut Eberlein, Würzburg, Fed. Rep. of Germany

[73] Assignee: Mero-Raumstruktur GmbH & Co. Würzburg, Würzburg, Fed. Rep. of Germany

[21] Appl. No.: 283,191

[22] Filed: Jul. 14, 1981

[30] Foreign Application Priority Data

Jul. 15, 1980 [DE] Fed. Rep. of Germany ..... 3026689

[51] Int. Cl.[3] ..... B25G 3/00; F16D 1/00

[52] U.S. Cl. ..... 403/287; 403/19; 403/267

[58] Field of Search ..... 403/170, 171, 172, 174, 403/176, 178, 267, 287, 21, 364, 22, 19

[56] References Cited

FOREIGN PATENT DOCUMENTS

| | | | |
|---|---|---|---|
| 1273131 | 8/1961 | France | 403/171 |
| 901955 | 6/1954 | German Democratic Rep. | 403/171 |
| 539924 | 2/1956 | Italy | 403/191 |
| 2012649 | 8/1979 | United Kingdom | 403/267 |
| 629297 | 9/1978 | U.S.S.R. | 403/174 |
| 676701 | 8/1979 | U.S.S.R. | 403/171 |

*Primary Examiner*—Andrew V. Kundrat

*Attorney, Agent, or Firm*—Jacobi, Siegel, Presta, Marzullo & Aronson

[57] ABSTRACT

An intersection joint for wooden members of trusses, particularly in spaceframes, with fixing elements for thread bolts attached on the ends of the wooden members, which are screwed into tapholes of joint elements. The fixing elements are configured as profile parts of one piece (at least in their attachment areas,) and secured into corresponding cutouts in the head ends of the wooden members.

13 Claims, 13 Drawing Figures

INTERSECTION JOINT FOR WOODEN MEMBERS OF TRUSSES PARTICULARLY FOR SPACEFRAMES

The invention relates to an intersection joint for wooden truss members, particularly for spaceframes, with fixing elements for thread bolts mounted on the head ends of the wooden members, inserted into tapholes of joint elements.

Similar intersection joints have been disclosed in DE-PS No. 896 712 and DE-AS No. 2 020 242. In both of the known constructions, the joint elements consist of steel or light metal, while the wooden members are round or square, for relatively low-cost spaceframe contructions, which in many cases easily fulfills the structured requirements. Each of these embodiments uses a plurality of U-shaped brackets for holding the thread bolts, which in one case are attached by means of claw-shaped ends and screws on the outside of a wooden member, and in the other case are inserted in axial slots in the heads of the wooden members, and are held in this position by transverse pins or screws. Fastenings of this type, however, are costly and also require relatively long work time, since numerous nails or screws must be driven into the wood to fasten the brackets.

And if the brackets are thick plates, they must even be rough-drilled beforehand for the nails or screws. The assembly is then even more complicated.

The object of the invention is to simplify this type of intersection joint so that it can be manufactured more quickly. Finally, also the connection lengths between the member heads and the joint elements are further reduced.

This is obtained according to the invention in that the fixing elements are configured as one-piece profile elements, and their profiles are glued into corresponding axial cutouts in the head ends of the wooden members. This greatly simplifies the fastening of a fixing element to the end of a wooden member, because the fixing element needs to be inserted only after application of the adhesive in the corresponding cutouts, which guarantees a sure anchoring of the fixing element to the wooden member end, after hardening of the adhesive. It is advantageous that the profile of the fixing element be configured to have many branches, for enlargement of the adhesive surface. The cutouts in the head ends of the wooden members could be manufactured relatively simply with intricate profiles, e.g., by the automatic profiling method. Very short connection lengths can also be used with fixing elements according to the invention.

The economy is further enhanced if the fixing elements according to another configuration of the invention consist of extrusion press profile elements. This has the particular advantage that the adhesive surface can thus be embodied in a simpler manner and a very large contact surface can be achieved between wooden members and connection parts for the transfer of forces.

If, according to still another configuration of the invention, each fixing element consists of an extrusion press element with sawtooth or the like profile or includes such in its configuration, this simplifies the finishing of the corresponding wedge-shaped cutouts in the heads of the wooden members. In this case, it suffices to use a suitable profiler, which is operating across the heads of the wooden members.

If, according to still another configuration of the invention, the fixing element has an axial groove with a T-shaped unobstructed transverse cross section on its area opposite to the sawtooth profile, to receive one or more thread bolts, which are affixed from the side, e.g., by pins, it is advantageous to use a one-piece fixing element for the thread bolt or bolts, which allows very short connection piece lengths. Besides, such a fixing element can as desired receive one or more thread bolts for the embodiment of multiple joints.

According to still another variation of the invention, the sawtooth profile can be tip-stretched on a plate engaging on the head end of the wooden member, on the outside of which can be mounted one or more hollow conical elements or the like to hold the thread bolt or bolts.

Still another configuration of the invention is characterized in that each fixing element consists of an extrusion press part with star-shaped or spoked wheel-shaped transverse cross section profile. It is advantageous to have the thread bolt(s) held in the center of the fixing element with such a profile, and the outside head side of this central part advantageously forms the mounting surface for a spanner sleeve which is pinned with the thread bolt(s) but is axially movable. This version of the invention allows an extremely short connection length, which practically corresponds only to the length of the movement allowed by the spanner sleeve.

In a simplified version of the invention, for relatively small loads, the fixing elements for the thread bolts consist of sheathings with corresponding tapholes. Extremely short connection lengths can also be attained in this case. This sheathing is of suitable diameter to provide sufficient adhesive surface.

The invention will now be explained relative to the drawings of exemplary embodiments. They show:

Figure 1:
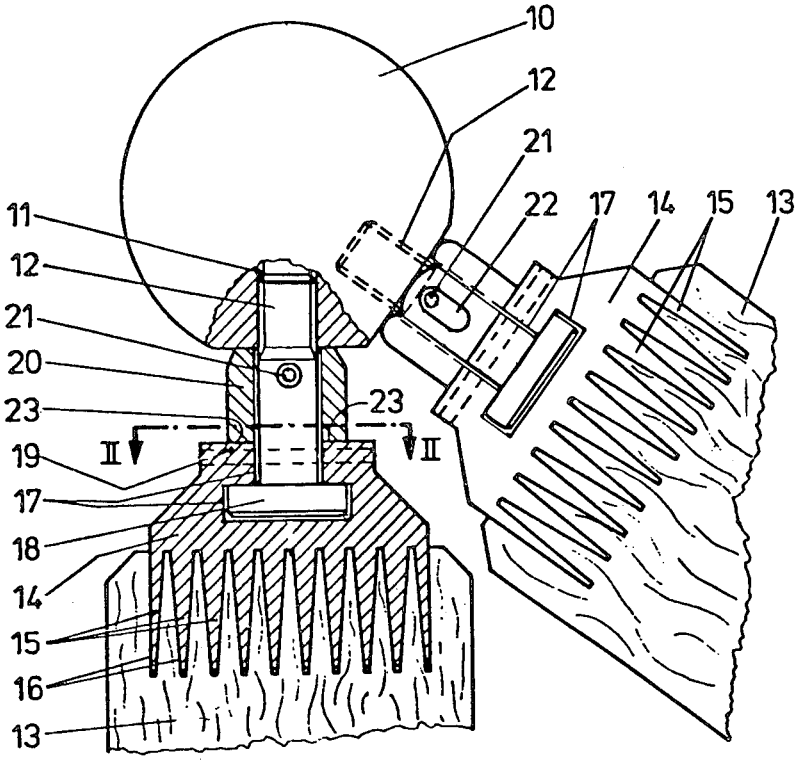
FIG. 1 is a side view of an intersection joint according to the invention, partially in cross section, in which extrusion press parts with sawtooth-shaped profile are provided as fixing elements for the thread bolts.

FIG. 1 shows a joint element 10 of an intersection joint in a room framework, in which are used wooden members 13. The joint element 10, which can be of steel, has several tapholes intersecting at the midpoint, which are present to receive thread bolts 12. For example, only two square wooden members 13 which have fixing elements 14 on their ends, each for a thread bolts 12, are attached to joint element 10.

Figure 2:
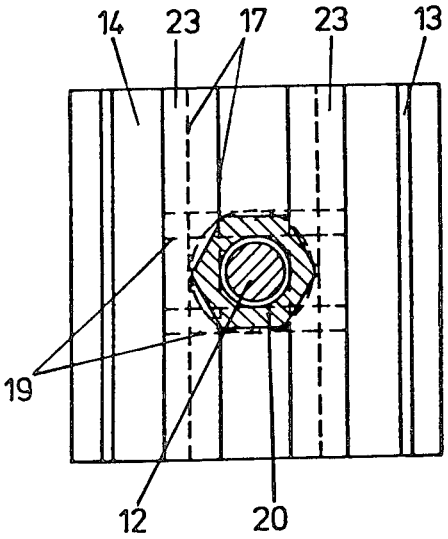
FIG. 2 is a cross section along line II—II of FIG. 1.
Figure 3:
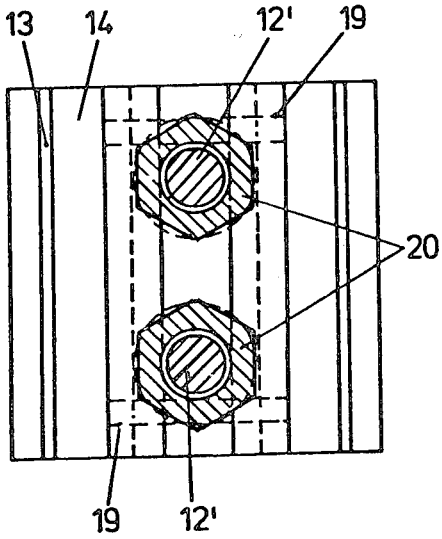
FIG. 3 is a cross section similar to that of FIG. 2, but which shows two thread bolts anchored in the fixing element for a double connection to a joint element.

Fixing elements 14 in the embodiment of FIGS. 1–3 consists of separate aluminum parts of an extrusion press profile, of which the lengths are dependent upon the cross sectional dimensions of wooden beams 13. Fixing elements 14 have a sawtooth-shaped profile 15 on their area serving for the attachment, which in this profile is fitted and glued in axial wedge-shaped cutouts 16 in the head end of wooden members 13. Special commercial adhesive for wood and metal can be used as adhesive for this purpose. The cutouts 16 preferably pass through from one side to the opposite side, formed e.g. by a suitable profile cutter. Thus, they are open at the sides, which has the advantage that excess adhesive can leak out there.

Fixing elements 14 furthermore have a T-shaped longitudinal groove 17 in their area projecting out from the head end of each wooden member 13, into which is inserted the thread bolt 12 with its head 18, which is held in the central position by two pins 19 which run transverse shown in FIG. 2.

An spanner sleeve 20 serves for the tapping of thread bolt 12 in the taphole 11 of joint element 10. Each spanner sleeve 20 is connected nonrotatably with its thread bolt 12 by a pin 21, which is anchored tightly in thread bolt 12 and extends in a longitudinal hole 22 of the spanner sleeve (key bushing). This spanner sleeve arrangement is known and therefore needs no further explanation. In a completed connection, spanner sleeve 20 lies with one head on a flattened part of joint element 10 and with its opposite head on the surface 23 on both sides of groove 17 with T-shaped unobstructed transverse cross section.

FIG. 3 shows that fixing element 14 can also have two thread bolts 12′ (and if longer, even more than two thread bolts). Also in this case, thread bolts 12′ cannot come out at the sides of groove 17 because of transverse pins 19.

Figure 4:
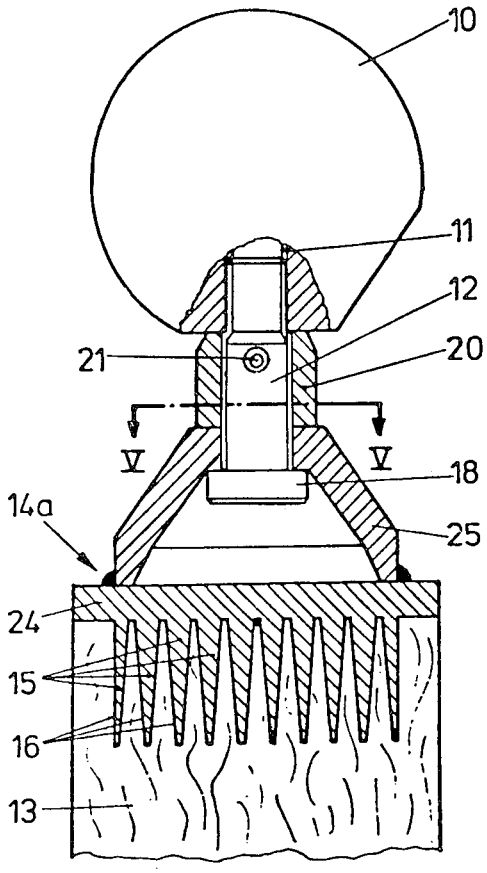
FIG. 4 is a side view of an intersection joint which shows another embodiment of a fixing element for one or more thread bolts.
Figure 6:
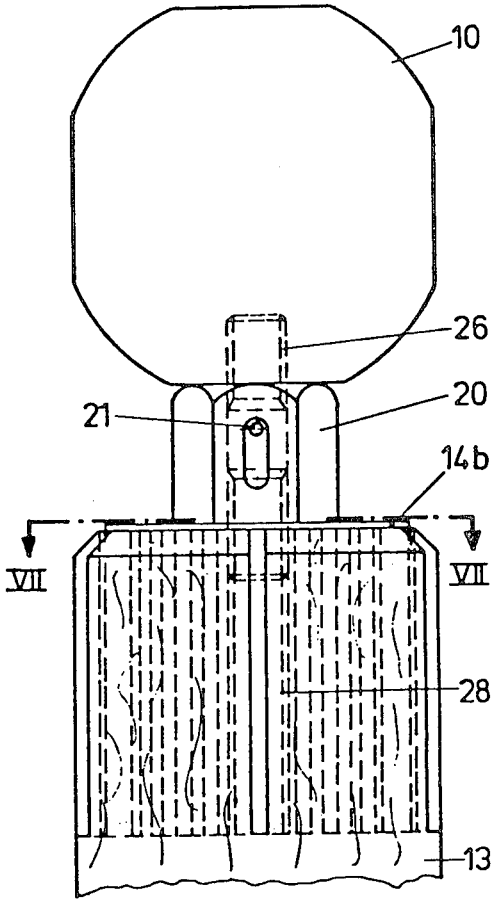
FIG. 6 is a side view of an intersection joint which shows still another embodiment of the invention, with a fixing element for one thread bolt, which has a spoked wheel-shaped transverse cross section.
Figure 5:
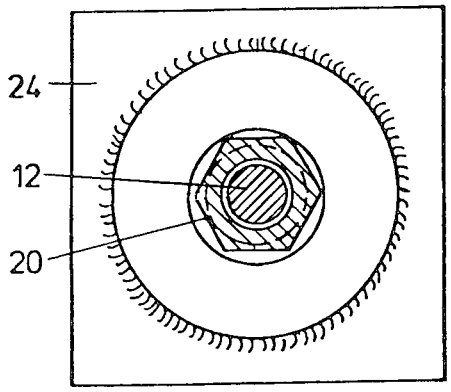
FIG. 5 is a cross section along line V—V of FIG. 4.

In the embodiment shown in FIGS. 4 and 5, only one square wooden member 13 is attached to joint element 10, for example. Fixing element 14*a* for thread bolt 12 in this embodiment consists of an aluminum extrusion press part 24, which has a sawtooth-shaped profile 15 on its underside, the same as the embodiment of FIGS. 1–3, which is glued into corresponding axial wedge-shaped cutouts 16. A hollow aluminum conical element 25 is welded on the outside of part 24, in which is held thread bolt 12 with its head 18.

The embodiment as shown in FIGS. 6–9 has a holding or support element 14*b* for a thread bolt 26 with a spoked wheel-shaped transverse cross section, in which a taphole 28 is provided in the central part 27 for thread bolt 26. Fixing element 14*b* is preferably an aluminum extrusion press part, and the separate fixing elements from the extrusion press profile are of such lengths that a sufficiently large adhesive surface is attained.

Thread bolt 26 in this embodiment is configured as a differential thread bolt, which is known in joint connections of space frameworks and trusses and therefore needs no further explanation. The pinned connection between thread bolt 26 and spanner sleeve 20, which however is axially relatively movable, corresponds to the embodiment shown in FIGS. 1 and 4.

Figure 7:
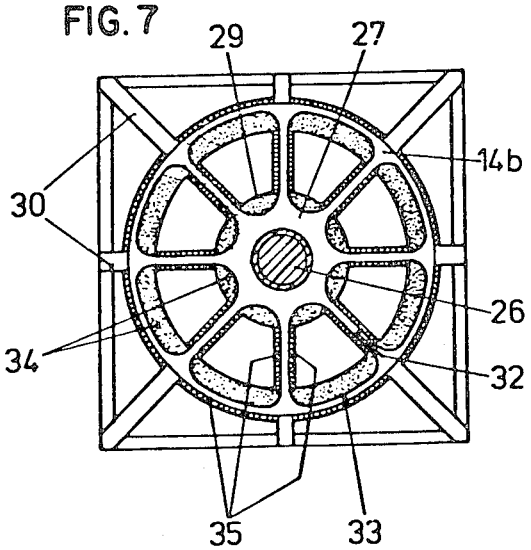
FIG. 7 is a cross section along line VII—VII of FIG. 6.
Figure 8:
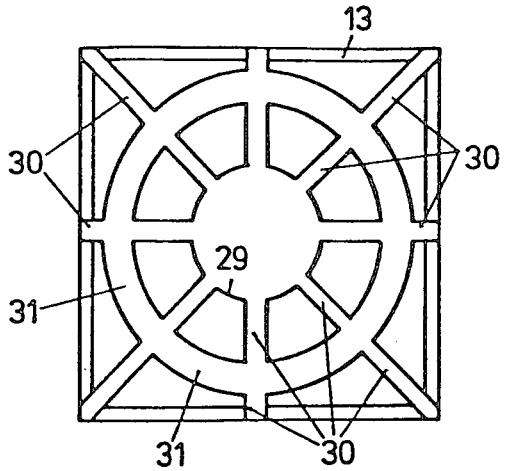
FIG. 8 is a top view of the wooden member of FIG. 6 without glued-in fixing element.
Figure 9:
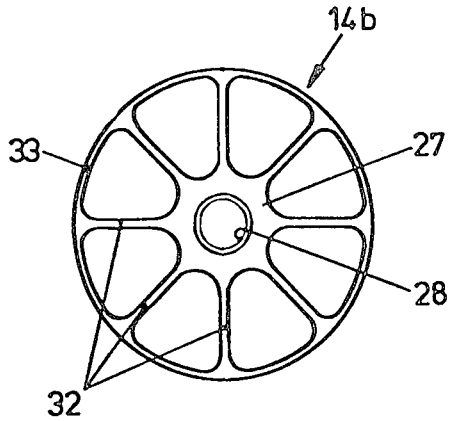
FIG. 9 is a top view of the fixing element used in FIGS. 6 and 7.

Fixing element 14*b* is glued into the end of the square wooden member 13 in the corresponding cutouts. For this purpose, in each head end of square wooden member 13 is provided a central axial bore 29, from which slots 30 run radially outward. Coaxial to bore 29 is provided a circular cutout 31. Bore 29, slots 30 and cutout 31 are all cut to a depth which corresponds approximately to the dimensions of fixing element 14*b* (see FIG. 6). On the other hand, the diameter of bore 29 and width of slots 30 as well as annular cutout 31 are of such dimensions that intermediate side spaces (FIG. 7) remain when fixing element 14*b* is inserted, which serve to hold adhesive material. The central part 27 of fixing element 14*b* is held in bore 29, while the spokes 32 sit in slots 30. The rim-shaped outside peripheral area 33 of fixing element 14*b* fits in annular cutout 31. FIG. 7 shows that the intermediate space remaining between inserted fixing element 14*b* and bore 29, slots 30 and annular cutout 31, is filled by a filler adhesive 34 or special adhesive 35. These adhesives can be obtained commercially. Since slots 30 are open to the side, with insertion of fixing element 14*b*, excess adhesive can be advantageously drained off to the side.

Figure 10:
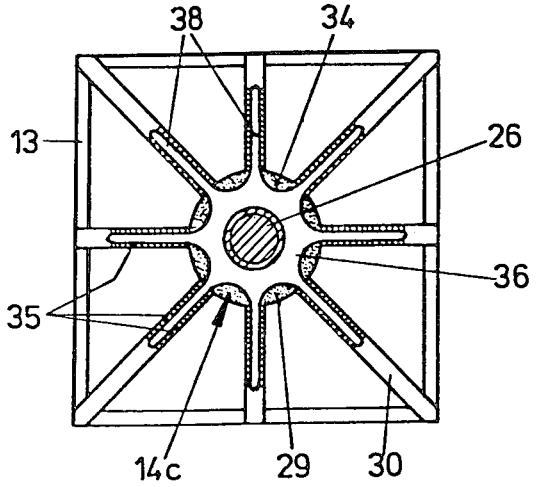
FIG. 10 is a cross section similar to that of FIG. 7 of a third embodiment of the invention, with a fixing element for the thread bolt, having a star-shaped transverse cross section.
Figure 11:
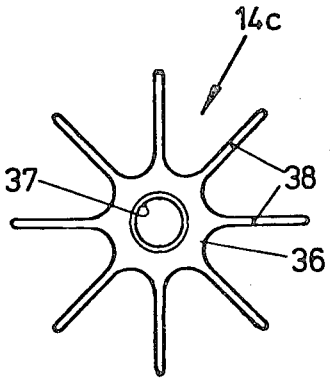
FIG. 11 is a top view of the fixing element used in the embodiment shown in FIG. 10.

FIGS. 10 and 11 show fixing element 14*c* with star-shaped transverse cross section for thread bolt 26. In detail, this fixing element has a central part 36 with a taphole 37 to receive thread bolt 26. Identical bars 38 run radially outward from central part 36. Fixing element 14*c* preferably consists of an aluminum extrusion press part, which is cut into predetermined lengths by an extrusion press profile. This fixing element is glued in, as before in the embodiment of FIGS. 6–9, in an axial bore 29 in the head of square wooden member 13, from which slots 30 run radially outward. The central part 36 of fixing element 14*c* is again fitted into axial bore 29, while the bars 38 fit in slots 30. As before, sufficient intermediate space is left to receive a suitably fitting special adhesive 35 or filler adhesive 34, as shown in FIG. 10, between fixing element 14*c* and bore 29 or respectively slots 30.

Figure 12:
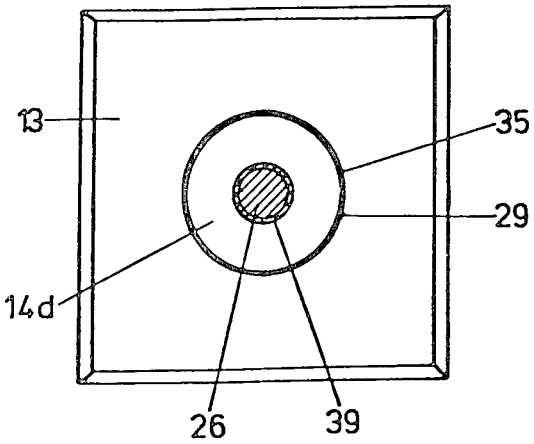
FIG. 12 is a cross section similar to that of FIGS. 7 and 10 of a fourth embodiment of the invention, with a fixing element in the form of a sheathing with inside threading.
Figure 13:
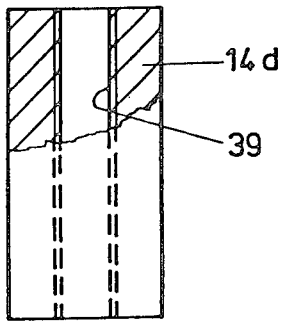
FIG. 13 is a longitudinal cross section of the built-in fixing element as in the embodiment of FIG. 12.

In the embodiment shown in FIGS. 12 and 13, fixing element 14*d* for thread bolt 26 consists of a simple sheathing which can be aluminum, with a corresponding taphole 39. The diameter of this sheathing is smaller than that of central bore 29 in the head of square wooden member 13, in order to leave sufficient space for the insertion of special adhesive 35 when fixing element 14*d* is glued in. Furthermore, the diameter of fixing element 14*d* is such that a sufficiently large adhesive surface is available.

What is claimed is:

1. In an intersection joint for a wooden truss member wherein a thread bolt with a head portion is secured on the end of the truss member by a fixing element, the improvement wherein the fixing element comprises at least one elongated portion extending toward the truss member, the end of the truss member comprises a recess for receiving said elongated portion therein, and means is provided for securing said elongated portion to the truss member when it is positioned in said recess.

2. Intersection joint as in claim 1 wherein said recess corresponds generally in size and shape to that of said elongated portion.

3. Intersection joint as in claim 2 wherein said securing means is an adhesive.

4. Intersection joint as in claim 1 wherein the fixing element is of one piece construction.

5. Intersection joint as in claim 3 wherein the fixing element comprises a plurality of elongated portions and the end of the truss member comprises a plurality of corresponding recesses to provide a large surface area for adhesively securing said elongated portions to the truss member.

6. Intersection joint as in claim 5 wherein said elongated portions are of sawtooth-shaped configuration.

7. Intersection joint as in claim 1, characterized in that the fixing element has an axial groove with a generally T-shaped transverse portion on the side thereof opposite to said elongated portion, the thread bolt being received in said axial groove with its head portion in said transverse portion, and means for retaining the thread bolt in said axial groove.

8. Intersection joint as in claim 7 wherein said retaining means comprises a pair of pins extending across said transverse portion on opposite sides of the thread bolt head portion.

9. Intersection joint as in claim 1, characterized in that said elongated portion is formed on a fixing element plate in engagement with the end of the truss member, and a generally hollow conical element is mounted on said plate to support the thread bolt.

10. Intersection joint as in claim 5, characterized in that the fixing element comprises a generally spoked wheel-shaped transverse cross section.

11. Intersection joint as in claim 5, characterized in that the fixing element comprises a generally star-shaped transverse cross section.

12. Intersection joint as in claim 1 wherein a spanner sleeve surrounds the outer end of the thread bolt and is in engagement with the adjacent outer surface of the fixing element, said spanner sleeve being connected to the thread bolt so as to be axially movable relative thereto and nonrotatably fixed thereto.

13. Intersection joint as in claim 1, characterized in that the fixing element is of generally cylindrical construction with an axial bore which receives the thread bolt therein.

* * * * *